US008572854B2

(12) United States Patent
Estoppeij

(10) Patent No.: US 8,572,854 B2
(45) Date of Patent: Nov. 5, 2013

(54) CUTTING TOOL

(75) Inventor: Erik Willem Estoppeij, Tokyo (JP)

(73) Assignee: Hoya Corporation, Tokyo (JP)

( * ) Notice: Subject to any disclaimer, the term of this patent is extended or adjusted under 35 U.S.C. 154(b) by 311 days.

(21) Appl. No.: 12/950,559

(22) Filed: Nov. 19, 2010

(65) Prior Publication Data

US 2011/0138635 A1 Jun. 16, 2011

(30) Foreign Application Priority Data

Nov. 20, 2009 (JP) ..... 2009-265299

(51) Int. Cl.
*B26B 3/04* (2006.01)

(52) U.S. Cl.
USPC ..... 30/299; 30/304

(58) Field of Classification Search
USPC ..... 30/280, 287, 299, 301–305; 234/42, 43, 234/94, 97, 98, 101, 106
See application file for complete search history.

(56) References Cited

U.S. PATENT DOCUMENTS

| | | | | | |
|---|---|---|---|---|---|
| 1,380,008 | A | * | 5/1921 | Otto | 30/287 |
| 1,586,267 | A | | 5/1926 | Rector | |
| 2,716,950 | A | | 9/1955 | Johnston | |
| 2,810,193 | A | * | 10/1957 | Glodde | 30/280 |
| 2,992,483 | A | * | 7/1961 | Ricci | 30/280 |
| 3,733,466 | A | * | 5/1973 | Krumrey | 234/98 |
| 3,903,948 | A | * | 9/1975 | Christie et al. | 30/299 |
| 4,021,912 | A | * | 5/1977 | Stanfield | 30/280 |
| 4,358,893 | A | * | 11/1982 | Stanfield | 30/280 |
| D282,901 | S | * | 3/1986 | Quinn | D8/98 |
| 4,798,213 | A | * | 1/1989 | Doppelt | 30/301 |
| 5,446,965 | A | | 9/1995 | Makridis | |
| 6,497,045 | B1 | * | 12/2002 | Forgani | 30/305 |
| 6,622,908 | B2 | * | 9/2003 | Fukumoto et al. | 234/98 |
| 7,458,505 | B2 | * | 12/2008 | Majima et al. | 234/98 |
| 2011/0283548 | A1 | * | 11/2011 | White | 30/301 |

FOREIGN PATENT DOCUMENTS

| | | | |
|---|---|---|---|
| EP | 2324972 | A1 * | 5/2001 |
| JP | 2011104566 | A * | 6/2011 |
| WO | WO 92/20270 | | 11/1992 |

OTHER PUBLICATIONS

Extended European Search Report issued Mar. 9, 2011, in Patent Application No. 10191667.4.

Japanese Industrial Standards (JIS) K5600-5-6, 1999, pp. 3-5 (With English Translation).

* cited by examiner

*Primary Examiner* — Jason Daniel Prone

(74) *Attorney, Agent, or Firm* — Oblon, Spivak, McClelland, Maier & Neustadt, L.L.P.

(57) ABSTRACT

A cutting tool includes: a plurality of shaft parts having blades at respective one ends and projections at the other ends; a shaft-receiving part having cylindrical parts fitting to portions of the shaft parts; a guide part having projection-receiving parts extending in one direction, respectively; and stretchable elastic bodies positioned between the blades and the shaft-receiving part, wherein the projections are movably fitted to the respective projection-receiving parts.

7 Claims, 7 Drawing Sheets

CUTTING TOOL

This application is based on and claims priority to Japanese Application No. 2009-265299, filed Nov. 20, 2009. The entire contents of which are incorporated herein by reference.

TECHNICAL FIELD

The present invention relates to a cutting tool used in a cross-cut method for evaluating adhesion of a coating film formed on various products.

BACKGROUND ART

Japanese Industrial Standards (JIS) specifies the cross-cut method as the method for evaluating adhesion of a coating film on various industrial products.

The method evaluates adhesion between a substrate, such as plastics, glass, metal, etc., and a coating film formed thereon, by creating flaws in a lattice pattern on the coating film, attaching an adhesive tape thereon and then peeling off the adhesive tape from the substrate, and observing the condition of torn squares of the lattice pattern.

According to JIS, the cross-cut method is specified for a single-blade cutting tool and a multiple-blade cutting tool as a cutting tool (refer to Non-Patent Document 1, pp. 3-5.)

Non-Patent Document 1: Japanese Industrial Standards (JIS) K5600-5-6 (1999)

DISCLOSURE OF THE INVENTION

Problems to be Solved by the Invention

Use of a multiple-blade cutting tool raises a difficulty in evaluating coating films formed on an object having a curved surface with a plurality of curvatures and an object having a free-form curved surface, such as spectacle lenses. The difficulty is caused from the presence of regions where blade edges of multiple-blades do not fit to a curved surface, thus the blade edges cannot be pressed into a coating film on the curved surface at a constant force to create incisions in the coating film.

Accordingly, for evaluating a coating film on an object having a complex curved surface, such as a curved surface with a plurality of curvatures and a free-form curved surface, a single-blade cutting tool is adopted. However, in the case of evaluation on 10×10 squares of a lattice pattern for example, use of a single-blade cutting tool creates a large number of cutting lines. For the evaluation of a very hard coating film, such as an anti-reflection film as an inorganic vapor deposition layer, a hard-coat layer with increased surface hardness, etc., there is required a strong force for making incisions. With those reasons, there are often cases of difficulty in creating incisions at a uniform depth even with the single-blade cutting tool. Once a variation in the depths of cutting lines appears, the evaluation of adhesion varies, which raises a problem of poor reliability.

When conducting cross-cutting, not limited to the single-blade cutting tool, even the multiple-blade cutting tool needs to create a plurality of linear and parallel cutting lines, however, depending on the shape of a curved surface of a testing material and the shapes of blades, straight lines may skew in some cases. Such skewed cutting lines also cause a variation in the incision depth.

In view of the above-described problems, an object of the present invention is to create cutting lines with improved uniform depths and shapes in a coating film formed on an object having a curved surface with a plurality of curvatures or a free-form curved surface.

Means for Solving the Problems

To solve the above-described problems, the present invention provides a cutting tool having a plurality of blades, the cutting tool including: a plurality of shaft parts having blades at respective one ends and projections at positions distant from the blades; a shaft-receiving part having cylindrical parts to fit to portions of the shaft parts; a guide part having receiving parts of the projections extending in one direction; and stretchable elastic bodies positioned between the blades and the shaft-receiving part. The shaft parts are held by the shaft-receiving part such that the projections are movably fitted to the receiving parts, respectively.

According to the cutting tool of the present invention, by positioning the elastic bodies between the blades and the shaft-receiving part, when the blades are pressed by an irregular surface of a testing material, the shaft parts having the blades are pressed against the shaft-receiving part. Owing to expansion and contraction of the elastic bodies, however, the shaft parts move separately from the shaft-receiving part. On the other hand, the projections of the shaft parts are held by the shaft-receiving part movably relative to the receiving parts formed of slits, grooves, and the like extending in one direction. Consequently, in the cutting tool, moving directions of the shaft parts having the projections are restricted to extending directions of the receiving parts, and thus moving directions of the blades are restricted to certain directions which are in parallel with each other.

According to the cutting tool of the present invention, therefore, firstly the elastic bodies absorb movement of the blades following the curved surface profile of a testing material. Accordingly, even when an excessive force is applied to a blade, it is possible to disperse the force and make the force applied from the blade edge to the surface of the testing material further uniform. Furthermore, the displacement direction of the blade during cutting is restricted to the extending direction of a groove to which the projection fits, thereby restricting lateral displacement of the blade and displacement of the blade in a rotational direction centering on the shaft part when an excessive force has been applied to the blade, so that displacement of the blade edge can be restricted. As a result, even when the curvature of a surface of a testing material varies to apply a force to the blade in a direction crossing the cutting direction, displacement of the blade in a direction other than a desired direction can be suppressed or avoided. Therefore, even in the case that the surface of a testing material has a complex curved surface such as free-form curved surface, further uniform depths and shapes of incisions can be attained under a force in a slant or lateral direction relative to the cutting direction.

According to the cutting tool of the present invention, there can be adopted a structure in which the projections are formed by folding in L-shapes ends of the shaft parts opposite to the side of mounting the blades. With such structure, the shaft parts can be made relatively simple in shape, and alignment with blade edge directions becomes easy.

In this case, the guide part may be a plate-shape member in which a plurality of slits or grooves corresponding to the number of blades have been formed as the receiving parts. By fitting the L-shape projections to the slit-like or groove-like receiving parts, the projections can be easily configured to be movable in one direction.

The blades can be arranged in two rows. In this case, projections corresponding to blades in one row of the blades arranged in two rows can be formed extending longer than projections corresponding to blades in the other row, and the projections corresponding to the blades arranged in two rows fit to the receiving parts of the guide part, respectively. With such structure, each member becomes simple in structure, assembling and disassembling of respective parts becomes easy, and maintenance work of the cutting tool can be simplified. Also, adequate selection of distances between the shaft parts and the receiving parts provided in the guide part and distances between the projections and the receiving parts prevents inclusion of dust such as powder generated during cutting work.

In the present invention, the guide part may be integral with the shaft-receiving part, and the receiving parts of the projections may be formed in the cylindrical parts of the shaft-receiving part. In this case, the number of parts can be decreased to simplify the structure of the cutting tool.

Further, in the cutting tool of the present invention, it is preferable that the extending directions of blade edges of the blades and the projecting directions of the projections of the shaft parts are arranged in a fixed positional relation. With such structure, the shaft parts are allowed to move in specified directions relative to the moving directions of the blades, and thus it is possible to make the degrees of dispersion of forces when excessive forces are applied to respective blades further uniform. Therefore, it becomes possible to unify incision depths.

The elastic bodies are preferably structured by coil springs. With the use of a coil spring, it is possible to receive a portion of the shaft part inside of the coil spring, so that a simple structure is enabled.

Effects of the Invention

The present invention can create cutting lines with improved uniform depths and shapes on a coating film formed on an object having a curved surface with a plurality of curvatures or a free-form curved surface.

BRIEF DESCRIPTION OF DRAWINGS

FIGS. 4A, 4B, 4C, and 4D are schematic side views illustrating the core part of the cutting tool according to an embodiment of the present invention, in which FIGS. 4A and 4B illustrate shaft parts, FIG. 4C illustrates a blade, and FIG. 4D illustrates an elastic body, respectively.

FIGS. 9A, 9B, and 9C are schematic structure diagrams illustrating a support part of the cutting tool according to an embodiment of the present invention, in which FIG. 9A illustrates a top view, FIG. 9B illustrates a bottom view, and FIG. 9C illustrates a side view, respectively.

FIGS. 12A and 12B are schematic structure diagrams illustrating a core part of a cutting tool according to another embodiment of the present invention, in which FIG. 12A illustrates a side view, and FIG. 12B illustrates a top view, respectively.

BEST MODES FOR CARRYING OUT THE INVENTION

Best modes for carrying out the present invention are described below. However, the present invention is not limited to the following examples. The following examples deal with embodiments of a cutting tool suitable for evaluating adhesion of a coating film on a plastic lens. The cutting tool of the present invention, however, is not limited to such embodiments, and can be applied to evaluation of varieties of surfaces of testing materials.

The material of each part structuring the cutting tool of the present invention is not specifically limited, and there can be used various metals such as stainless steel, aluminum, and copper, various alloy materials, and ceramics, and the parts other than blades can be formed by moldable materials such as resin.

1. First Embodiment

Figure 1:
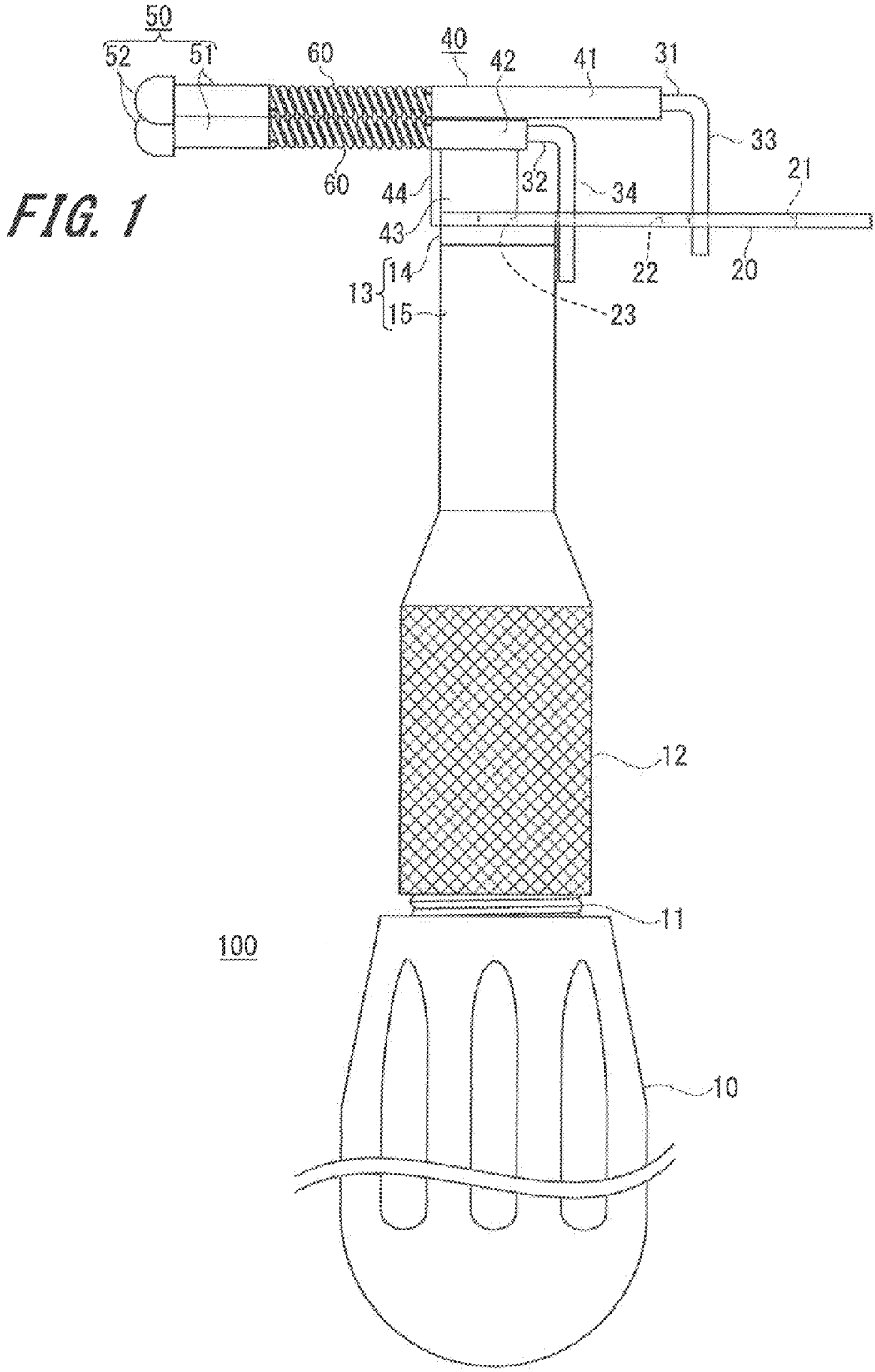
FIG. 1 is a schematic side view illustrating a cutting tool according to an embodiment of the present invention.
Figure 2:
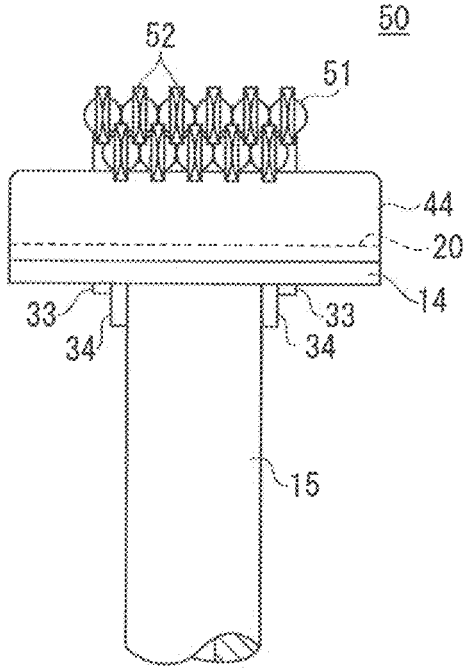
FIG. 2 is a schematic front view illustrating a core part of the cutting tool according to an embodiment of the present invention.
Figure 3:
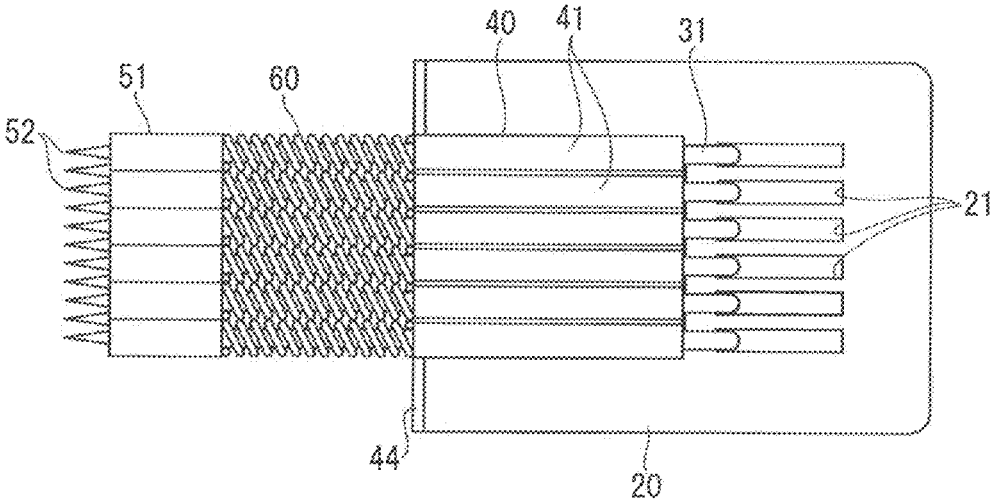
FIG. 3 is a schematic top view illustrating the cutting tool according to an embodiment of the present invention.

FIG. 1 illustrates a schematic side view of a cutting tool 100 according to the first embodiment of the present invention. FIG. 2 and FIG. 3 illustrate a front view and a top view of a core part of the cutting tool 100, respectively. In FIG. 2 and FIG. 3, the parts corresponding to those in FIG. 1 have the same reference numerals. As illustrated in FIG. 1, the cutting tool 100 has a grip 10, a support part 13 fixed to the grip 10 via locking parts 11 and 12, a guide part 20 of a plate-shape fixed onto the support part 13 by a screw, an adhesive, or the like (not shown), and a shaft-receiving part 40 having cylindrical parts 41 and 42 with lengths different from each other. Furthermore, the cutting tool 100 has a plurality of upper side shaft parts 31 and a plurality of lower side shaft parts 32, fitting to the cylindrical parts 41 and 42 of the shaft-receiving part 40, respectively. The shaft parts 31 and 32 have blades 50 at respective one ends (hereinafter referred to as the front end), and have projections 33 and 34 at positions distant from the blades 50, or in this case at the other end (hereinafter referred to as the rear end). The term "upper side" referred to herein signifies the vertical positioning when the grip 10 is held at the lower side and the shaft parts 31 and 32 are held at the upper side, and the term differs from the vertical positioning during use of the cutting tool 100.

As illustrated in FIG. 2, the example describes a case in which six upper side shaft parts 31 and five lower side shaft parts 32, that is, eleven shaft parts 31 and 32 in total, are arranged in two rows, each of the shaft parts having the blade 50, thus forming a multiple-blade structure. In this case, the total number of blades 50 is eleven, and eleven cutting lines are created by a single cutting work. The upper part may have five shaft parts and the lower part may have six shaft parts, or other quantity of shaft parts may be adopted. Furthermore, the arrangement may be in a single row instead of two rows.

According to the first embodiment, as illustrated in FIG. 1, the projections 33 and 34 provided at the rear ends of the shaft parts 31 and 32, respectively, are formed by folding in L-shapes ends of the shaft parts 31 and 32. The rear ends of the shaft parts 31 and 32 extend to the rear side such that the upper side shaft parts 31 become longer than the lower side shaft parts 32. Thereby, the projections 33 of the upper side shaft parts 31 are prevented from being interfered by the lower side shaft parts 32 and the projections 34 thereof, and the projections 33 and 34 reach the guide part 20, respectively.

As illustrated in FIG. 1 and FIG. 3, the guide part 20 has six slits 21 and five slits 22, eleven slits in total, as the receiving parts extending in one direction, corresponding to the above-described projections 33 and 34 of the shaft parts 31 and 32, respectively. With that structure, the projections 33 and 34 fit to the slits 21 and 22 of the guide part 20 movably along the shapes of the slits 21 and 22, respectively. The receiving parts for the projections 33 and 34 are not limited to the slits 21 and 22, and striped grooves may be also used. Furthermore, on the surface of the guide part 20, convex parts extending in certain directions may be created, and striped concavities formed between the convex parts may be used as the receiving parts. Other structure may be applied if the projections 33 and 34 are fitted so as to be movable in one direction.

At the front ends of the shaft parts 31 and 32, mounting parts 51 each in a cylindrical shape or the like and formed at the base side of the blade 50 are joined by fitting or the like. The mounting parts 51 are attached at the front ends of the shaft parts 31 and 32 so that the extending directions of blade edges 52 of the blades 50 align in one direction. It is preferred that the extending directions of the blade edges 52 keep a certain positional relation relative to the protruding directions of the projections 33 and 34 of the shaft parts 31 and 32. The projections 33 and 34 of the shaft parts 31 and 32 are arranged so as to project from the rear ends of the shaft parts 31 and 32 toward the plate-shape guide part 20. Accordingly, by keeping a certain positional relation between the projection directions of the projections 33 and 34 and the extending directions of the blade edges 52, or for example by keeping them in the same direction, the extending directions of all the blade edges 52 can easily be aligned.

The length of the blade edge 52 is preferably larger than the outer diameter of the mounting part 51. In this case, as illustrated in FIG. 2, the blades 50 are positioned so that portions of the blade edges 52 mounted to the upper shaft parts 31 and the blade edges 52 mounted to the lower shaft parts 32 overlap in a lateral direction (arranging-direction of the blades 50), and the upper blades 50 and the lower blades 50 are in alternate positioning in a slant direction without overlapping in the vertical direction. In this case, distances between the blades 50 can be made small, thus making the structure smaller.

Elastic bodies 60 such as coil springs, each having a stretchable property, are positioned between the blades 50 and the shaft-receiving part 40 fitting to the shaft parts 31 and 32. Use of coil springs as the elastic bodies 60 allows the shaft parts 31 and 32 to be inserted and positioned therein, which is preferable because of the simple structure. Each elastic body 60 is positioned so as to be caught between the mounting part 51 of the blade 50 and the end face of the shaft-receiving part 40 on the blade 50 side. Then, in a state not applying force to each blade 50, the distance between each blade 50 and the end face of the shaft-receiving part 40 is set such that each elastic body 60 has a specific length. That is, by uniformizing elastic constants, sizes, and shapes of the elastic bodies 60, and by arranging the elastic bodies 60 at a specified length in a non-operating state in which not pressure is applied, pressures applied to the respective blades 50 during operation become uniform owing to stretches of the elastic bodies 60 and movement of the shaft parts 31 and 32.

As described above, by mounting each blade 50 to the shaft-receiving part 40 via the elastic body 60, even when an excessive force is applied to the blade 50, the force is released, so that the force applied to the surface of a testing material becomes further uniform, thereby keeping the contact pressure on the blade 50 almost uniform. In addition, since the elastic body 60 allows the position of the blade edge 52 to move in the vertical direction (i.e., in the extending directions of the shaft parts 31 and 32), even when the surface of a testing material has a complex curved surface such as a curved surface with a plurality of curvatures, a free-form curved surface, etc., incisions, i.e., cutting lines, with almost equal depth, can be linearly created.

Furthermore, by moving the projections 33 and 34 provided in the shaft parts 31 and 32 along the shapes of the parallel slits 21 and 22 of the guide part 20, the moving directions of the shaft parts 31 and 32 are unified. As a result, the directions of forces applied to the blade edges 52 become further constant, thus allowing creating uniform cutting lines.

The shape of a side face of each blade edge 52 is preferably a curved shape, or in an arc shape as illustrated in FIG. 1. The side face shape is not limited to an arc shape, and for example it may be formed such that the center portion is in a straight line shape and both end corners are in curved shapes. By making at least one corner of the blade edge 52, specifically the corner in the cutting direction, in a curved shape, cutting along the extending direction of the blade edge 52 can surely be achieved even if a force is applied in a slant direction with respect to the cutting direction, during cutting work.

Figure 4A:
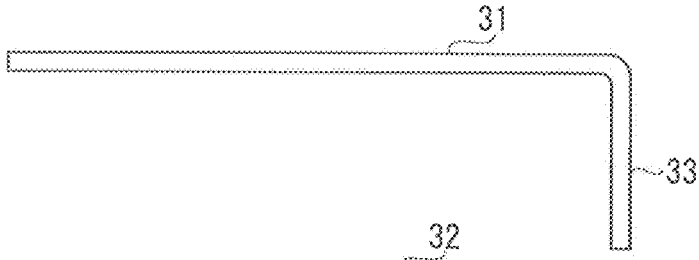
Figure 4B:
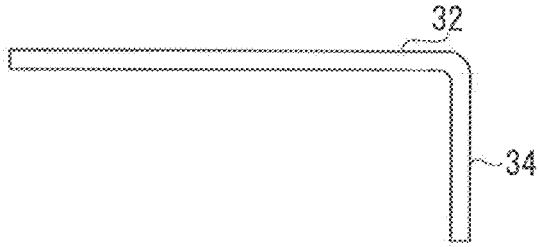

FIGS. 4A to 4D illustrate side views of the above-described shaft part 31, shaft part 32, blade 50, and elastic body 60, respectively, as separate parts. As shown in FIGS. 4A and 4B, the shaft parts 31 and 32 are formed, for example, in cylindrical shapes having the same diameter, while bringing the length of the shaft part 31 longer than the length of the shaft part 32. The projections 33 and 34 provided at respective rear ends are also formed, for example, in cylindrical shapes having the same diameter, and are formed by folding in L-shapes rear ends of the shaft parts 31 and 32, respectively, while bringing the length of the projection 33 longer than the length of the projection 34. The lengths of the projections 33 and 34 are only required to reach the respective slits 21 and 22 of the guide part 20, and in this case to penetrate therethrough, in a state that the shaft parts 31 and 32 are fitted to the cylindrical parts 41 and 42 of the shaft-receiving part 40, respectively. The lengths of the shaft parts 31 and 32 are adequately determined depending on the lengths of the respective slits 21 and 22 of the guide part 20. Both the shaft parts 31 and 32 and the slits 21 and 22 are preferably selected in their lengths depending on the use object, i.e., the size of a concavo-convex shape of the surface of a testing material.

Figure 4C:
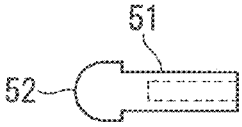

As illustrated in FIG. 4C, the shape of the blade 50 is for example in a cylindrical shape in the mounting part 51, and the shape of the side face of the blade edge 52 is for example in an arc shape. To attach the mounting parts 51 in a certain positional relation relative to the projections 33 and 34 of the shaft parts 31 and 32, respectively, i.e., to mount the blade edges 52 with respective ends aligned with each other, for example there may be provided marks or the like near the front ends of the shaft parts 31 and 32 and on cylinder surfaces of the mounting parts 51, or there may be formed a positioning structure such that the shaft parts 31 and 32 and the mounting parts 51 become stable in a fitting state at a position where a fine concavity and a fine convex are matched.

The shape of the blade edge 52 preferably has a double-blade structure, for example as the one specified in JIS K5600-5-6. Use of the double-blade structure creates a cutting line having a bilaterally symmetric cross section, thus allowing cutting with further uniform depth and shape.

Figure 4D:
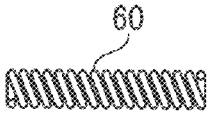

As illustrated in FIG. 4D, the elastic body 60 preferably uses a coil spring. As described above, the characteristics of respective elastic bodies 60, such as elastic constants, sizes, and shapes are preferably uniformized. The inner diameter of the coil spring is preferably larger than the diameters of the shaft parts 31 and 32, and smaller than the outer diameters of the mounting parts 51 for the blades 50 and the outer diameters of the cylindrical parts 41 and 42 of the shaft-receiving part 40. The outer diameter of the elastic body 60 is only required to be larger than the inner diameters of the mounting part 51 and those of the cylindrical parts 41 and 42. With that structure, the shaft parts 31 and 32 can be movably received in the elastic bodies 60, respectively, and by sandwiching the elastic bodies 60 between end faces of the mounting parts 51 and end faces of the cylindrical parts 41 and 42, respectively, the elastic bodies 60 can easily be positioned. Similar to the shaft parts 31 and 32 and the slits 21 and 22, the length of the elastic body 60 is preferably selected to match the size of a concavo-convex shape of a testing material, and the same applies to the length thereof in a state of being positioned between the blade 50 and the shaft-receiving part 40.

Figure 5:
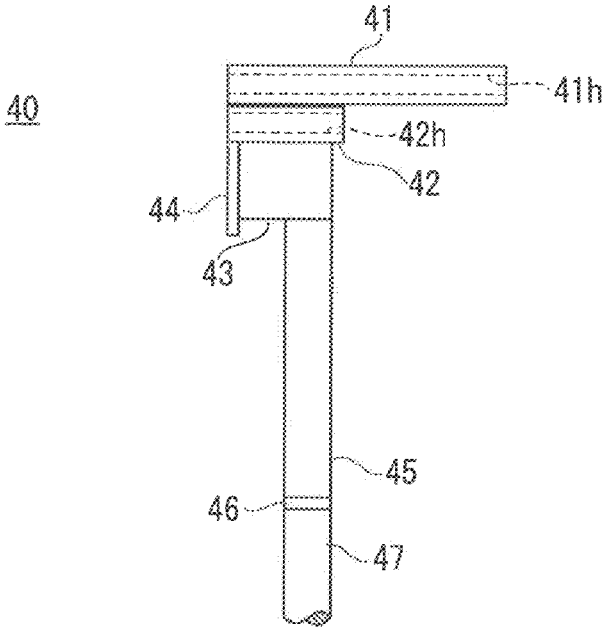
FIG. 5 is a schematic side view illustrating a shaft-receiving part of the cutting tool according to an embodiment of the present invention.
Figure 6:
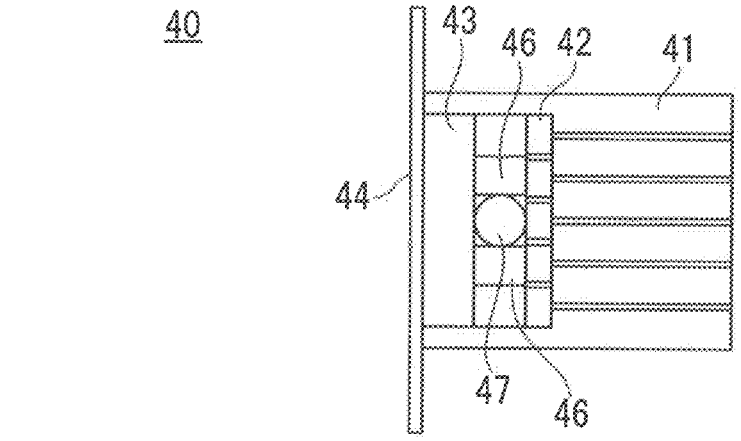
FIG. 6 is a schematic bottom view illustrating the shaft-receiving part of the cutting tool according to an embodiment of the present invention.
Figure 7:
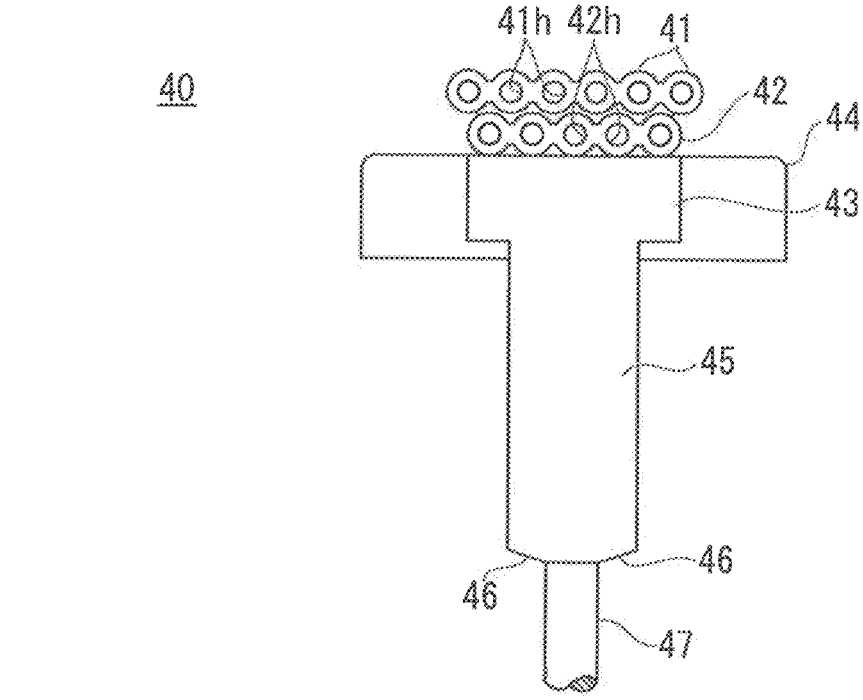
FIG. 7 is a schematic front view illustrating the shaft-receiving part of the cutting tool according to an embodiment of the present invention.

FIGS. 5 to 7 are a side view, a bottom view, and a front view of the shaft-receiving part 40, respectively. The shaft-receiving part 40 has the cylindrical part 41 fitting the shaft part 31 thereto, and the cylindrical part 42 fitting the shaft part 32 thereto. The cylindrical part 41 is formed longer than the cylindrical part 42. The cylindrical parts 41 and 42 are slightly larger than outer diameters of the shaft parts 31 and 32, and have respective pipe holes 41*h* and 42*h* with inner diameters not interfering movement of the shaft parts 31 and 32. The difference in length between the cylindrical part 41 and the cylindrical part 42 is only required to be in the same range as the difference in length between the shaft parts 31 and 32.

The numbers of the cylindrical parts 41 and 42 are six and five, matching the numbers of the shaft parts 31 and 32, respectively, and the cylindrical parts 41 and 42 are arranged one above the other and formed integrally. A pedestal 43 for example in a rectangular solid shape is fixed to lower parts of the cylindrical parts 41 and 42 by adhesion or the like. At the front side of the cylindrical parts 41 and 42, there is placed a plate-shape front part 44 for positioning and for rejecting powder generated during cutting work. Beneath the pedestal 43, there are integrally formed a support part 45 in a rectangular solid or other shape, and a mounting part 47 in a cylindrical or other shape further below the support part 45. The upper face of the support part 45 is similarly fixed to the lower face of the pedestal 43. The portion between the support part 45 and the mounting part 47 may be chamfered as necessary to form a slant surface 46. These pedestal 43, support part 45, and mounting part 47 may be formed integrally or may be assembled by fixing them together using an adhesive or the like.

Figure 8:
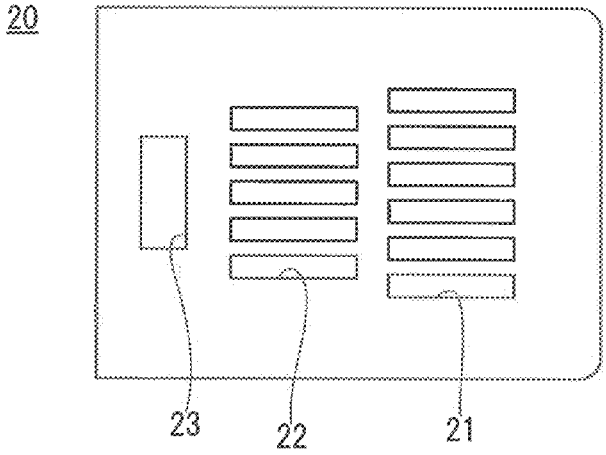
FIG. 8 is a schematic plan view illustrating a guide part of the cutting tool according to an embodiment of the present invention.

FIG. 8 shows a plan view of the guide part 20. As illustrated in FIG. 8, the guide part 20 is formed of a plate member, and has six slits 21 which fit to the respective projections 33 of the shaft parts 31, and five slits 22 which fit to the respective projections 34 of the shaft parts 32. As described above, the lengths of the slits 21 and 22 are adequately selected according to the concavo-convex shape of a testing material, similar to the case of the lengths of the shaft parts 31 and 32 and the elastic bodies 60. The widths of the slits 21 and 22 are only required to allow fitting and moving of the projections 33 and 34. The distance between adjacent slits is only required to match the distance between the blades 52, for example they may be in the same range. The guide part 20 has a hole part 23, for example, in a rectangular shape, allowing the support part 45 of the shaft-receiving part 40 to penetrate therethrough. The positions and the shapes of the hole part 23 and the support part 45 of the shaft-receiving part 40 are only required to be user-friendly when the operator holds the grip 10.

Figure 9A:
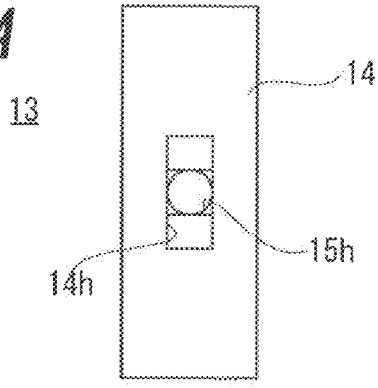
Figure 9B:
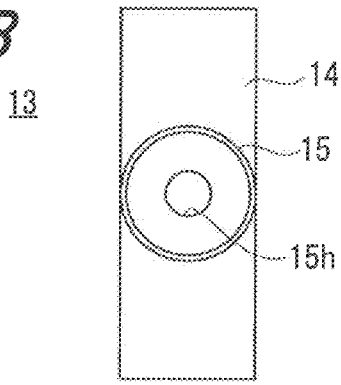
Figure 9C:
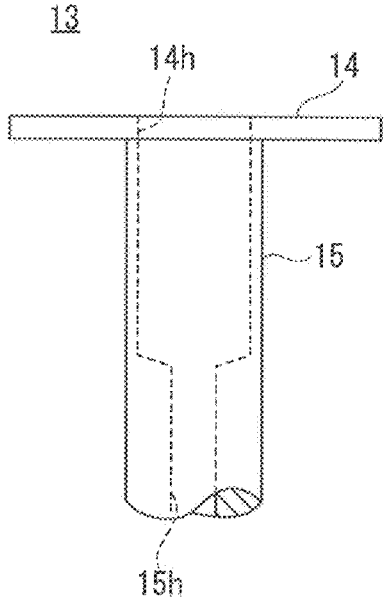

As illustrated in FIG. 1, the cutting tool 100 has the support part 13 below the guide part 20 to join the shaft-receiving part 40 with the grip 10. FIGS. 9A to 9C show a top view, a bottom view, and a side view of the support part 13, respectively. As illustrated in FIGS. 9A to 9C, the support part 13 has a pedestal 14 in a flat rectangular shape, and a shaft part 15 in a cylindrical or other shape fixed to the bottom of the pedestal 14. A hole part 14*h* in a rectangular shape is opened from the top face of the pedestal 14 to the shaft part 15 to allow the support part 45 of the shaft-receiving part 40 to penetrate therethrough. A hole part 15*h* in a cylindrical or other shape is opened in the shaft part 15 to connect with the hole part 14*h*, in which the mounting part 47 of the support part 45 is inserted. The shapes of the support part 45 and the mounting part 47 of the shaft-receiving part 40, the pedestal 14 of the support part 13, and the shaft part 15 are not limited to the above-described ones if only they can be attached to each other.

The shaft parts 31 and 32, the blades 50, the elastic bodies 60, the shaft-receiving part 40, the guide part 20, and the support part 13, described in FIGS. 3 to 9, are assembled together, and then they are joined to fix to the grip 10 by the locking parts 11 and 12, thus structuring the cutting tool 100 shown in FIG. 1. Joining of the shaft-receiving part 40 with the grip 10 using the locking parts 11 and 12 is carried out in the following procedure. For example, the locking parts 11 and 12 have threads on outer peripheries and inner peripheries thereof. By tightening the locking part 12, the inner diameter of the locking part 11 decreases, and thus the shaft part 15 of the support part 13 inserted therein is fixed to join together. Other than such structure, there can be applied various joining and fixing modes.

Figure 10:
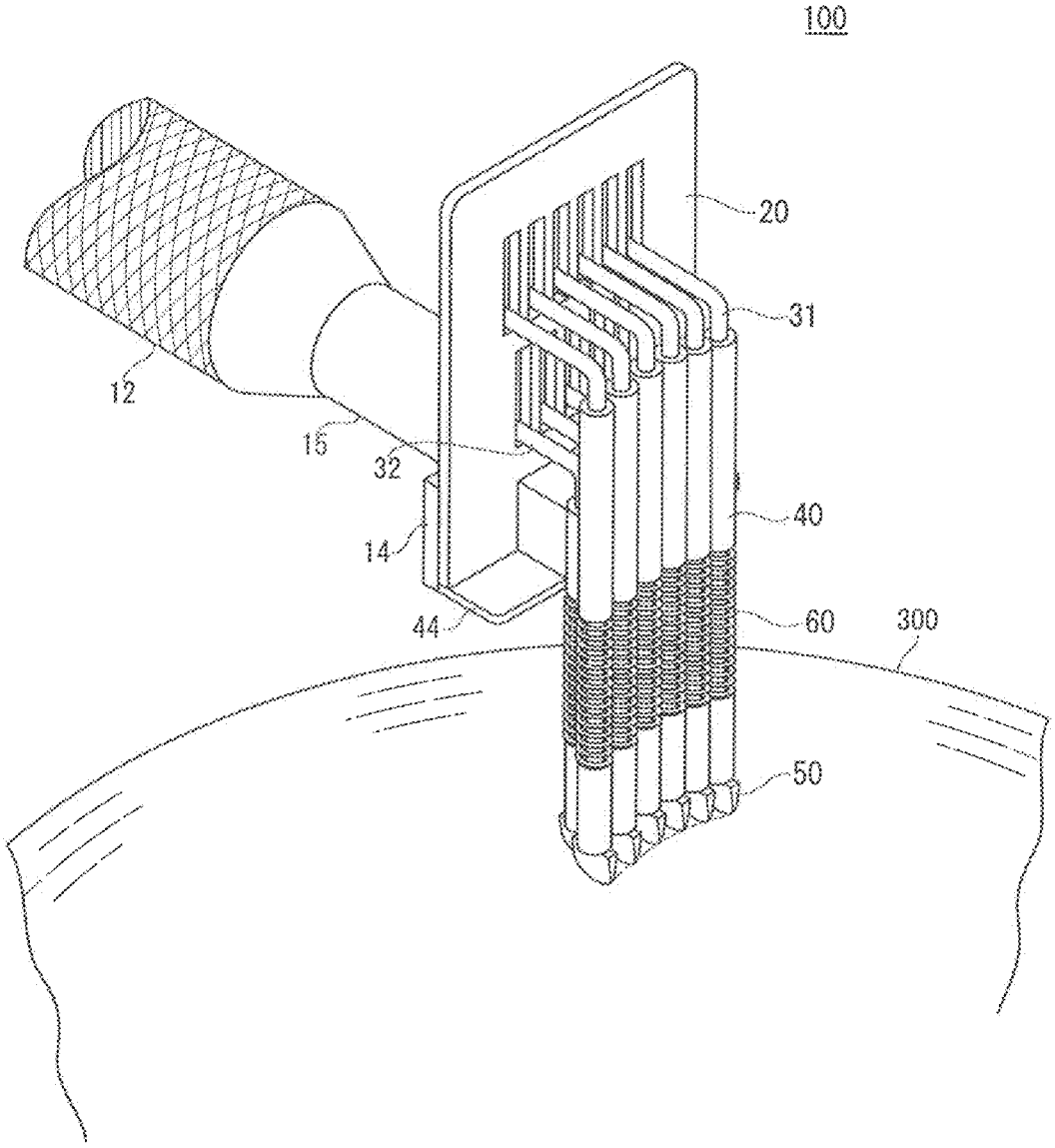
FIG. 10 is a schematic perspective view showing a use state of the cutting tool according to an embodiment of the present invention.
Figure 11:
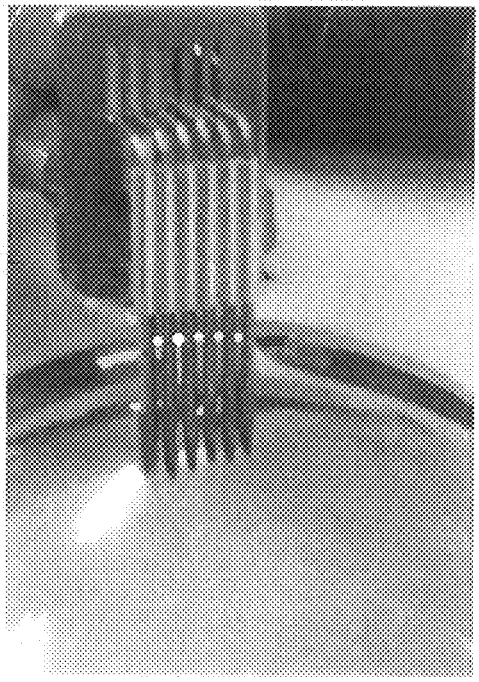
FIG. 11 is a reference drawing showing a use state of the cutting tool according to an embodiment of the present invention.

FIG. 10 illustrates a schematic perspective view showing a use state of the cutting tool 100. In FIG. 10, portions corresponding to those in FIG. 1 are attached with the same reference numerals, and duplicated description is avoided. FIG. 10 shows a state that the blades 50 of the cutting tool 100 are pressed against the coating face of a testing material such as a convex lens 300. FIG. 10 shows that the shaft parts 31 move along the slits 21 following the surface profile of the convex lens 300, and the blades 50 are pressed against the lens surface with almost equal forces, while lateral displacement of the blades 50 is restricted. As a reference drawing, FIG. 11 shows an example of a use state of the cutting tool 100.

2. Second Embodiment

Figure 12A:
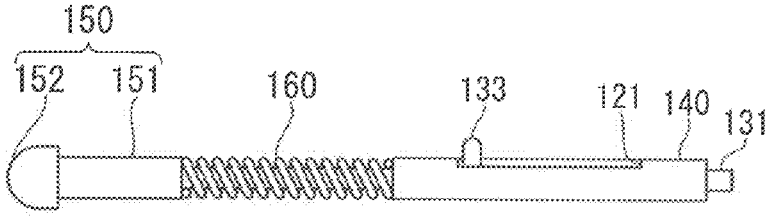
Figure 12B:
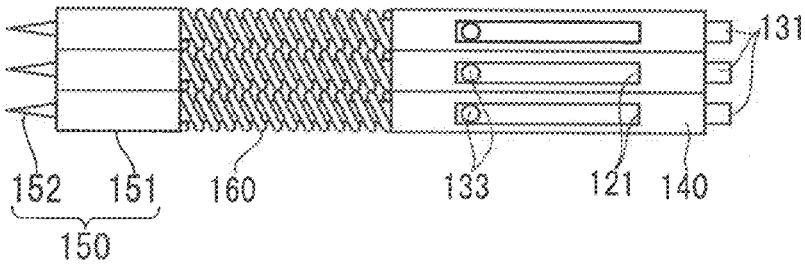

FIGS. 12A and 12B illustrate a schematic structure of a core part of a cutting tool according to another embodiment of the present invention. FIG. 12A is a side view, and FIG. 12B is a top view. As illustrated in FIGS. 12A and 12B, the cutting tool in this example does not use a separate member such as a plate as the guide part, and slits 121 are directly formed as the receiving parts in cylindrical parts of a shaft-receiving part 140. Consequently, shaft parts 131 have projections 133 at positions to be fitted to the cylindrical parts of the shaft-receiving part 140, not at the rear ends. Shapes and mounting modes of blades 150 mounted to the front ends of the shaft parts 131, mounting parts 151 of the blades 150, blade edges 152, and elastic bodies 160 positioned between the blades 150 and the shaft-receiving part 140 can be similar to those of the cutting tool 100 in the first embodiment.

The projection 133 in this case is a cylinder projecting from an outer peripheral surface of the shaft part 131, and the upper part thereof may be in a smooth shape such as a hemisphere. The length of the slit 121 is adequately selectable similar to the slit 21 of the cutting tool 100 described in the first embodiment. FIG. 12B shows a state of arranging three shaft parts 131. However, similar to the first embodiment, the number of the shaft parts 131 may be six, and similarly five shaft parts may be separately arranged at the lower part. A support part formed on the shaft-receiving part 140, a grip joining thereto, and the like may have structures similar to those of the above-described cutting tool 100.

With such structure, as in the cutting tool 100 of the first embodiment, by arranging the elastic bodies 160 between the blades 150 and the shaft-receiving part 140, incisions, i.e., cutting lines, with almost equal depths, can be created linearly, even when the surface of a testing material has a complex curved surface such as a free-form curved surface.

Also, by moving the projections 133 of the shaft parts 131 along the shapes of the parallel slits 121 provided in the shaft-receiving part 140 as the guide part, the moving directions of the shaft parts 131 are unified. As a result, directions of the forces applied to the blade edges 152 become further constant, which allows creating uniform cutting lines.

As described above, according to the cutting tool of the present invention, it is possible to create cutting lines with further uniform depths and shapes compared with the conventional method, and therefore, it becomes possible to evaluate a coating film having a complex curved surface under the same condition as in the conventional method.

The present invention is not limited to the structure described in the embodiments, and regarding the material and shape of a grip, the number and arrangement mode of blades, and the like, it should be understood that various modifications and alterations may be applied insofar as they are within the scope of the appended claims or the equivalents thereof.

DESCRIPTION OF REFERENCE SYMBOLS

10: grip
11, 12: locking part
13: support part
14: pedestal
**14*h***: hole part
15: shaft part
**15*h***: hole part
20: guide part
21, 22: slit
23: hole part
31, 32, 131: shaft part
33, 34, 133: projection
40, 140: shaft-receiving part
41, 42: cylindrical part
43: pedestal
44: front part
45: support part
47: mounting part
50: blade
150, 51, 151: mounting part
52, 152: blade edge
60, 160: elastic body
100: cutting tool
300: testing material

What is claimed is:

1. A cutting tool comprising: a plurality of shaft parts each having a first portion extending in a first direction and a projecting portion extending in a second direction perpendicular to the first direction thereby forming an L-shape, each of the first portions having an end spaced from the projecting portion, each of the ends incorporating a blade; a shaft receiving part having cylindrical parts to movably receive respective ones of the first portions of the shaft parts; a stretchable elastic body positioned on each of the first portions of the shaft parts between the blade and respective ones of the cylindrical parts; and a plate-shaped guide part having projection-receiving parts that movably receive respective ones of the projecting portions of the shaft parts, the projection-receiving parts each having a longitudinal axis extending parallel to the first direction.

2. The cutting tool according to claim 1, wherein the projection-receiving parts are slits or grooves.

3. The cutting tool according to claim 1, wherein the shaft parts are arranged in two rows thereby forming a first row of the blades and the projecting portions and a second row of the blades and the projecting portions, wherein the first row of the projecting portions are longer in the second direction in relation to the second row of the projecting portions.

4. The cutting tool according to claim 3, wherein the projection-receiving parts are formed in two rows, wherein a first row of the projection-receiving parts receives the first row of the projecting portions and a second row of the projection-receiving parts receives the second row of the projecting portions.

5. The cutting tool according to claim 1, wherein the elastic bodies are coil springs.

6. The cutting tool according to claim 1, further comprising a pedestal with an upper face mounted on the plate-shaped guide part along an axis extending parallel to the second direction, the shaft-receiving part is mounted on the upper face of the pedestal along the axis, and wherein the cylindrical parts of the shaft receiving part extend perpendicular to the axis.

7. The cutting tool according to claim 1, wherein each of the blades has a curved cutting edge.

* * * * *